United States Patent [19]

Cyrot

[11] 4,014,248

[45] Mar. 29, 1977

[54] SERVOMECHANISM CONTROLLED STEP BY STEP

[75] Inventor: Luc Cyrot, Mission Viejo, Calif.

[73] Assignee: D.B.A., Clichy, France

[22] Filed: June 6, 1975

[21] Appl. No.: 584,286

[30] Foreign Application Priority Data

Apr. 4, 1972 France .....72.11722
Nov. 15, 1972 France .....72.40477

Related U.S. Application Data

[63] Continuation of Ser. No. 346,328, March 30, 1973, abandoned.

[52] U.S. Cl. ..... 91/19; 91/20; 91/357; 91/409; 91/417 R; 91/445; 91/390

[51] Int. Cl.[2] ..... F15B 15/17; F15B 9/02

[58] Field of Search ..... 91/19, 20, 357, 409, 91/417, 445, 390, 167 R, 408

[56] References Cited

UNITED STATES PATENTS

| | | | |
|---|---|---|---|
| 2,244,296 | 6/1941 | Heinrich et al. | 91/357 |
| 2,954,755 | 10/1960 | Pecchenino | 91/357 |
| 3,411,413 | 11/1968 | MacNeill | 91/357 |
| 3,732,027 | 5/1973 | Lupke | 91/445 |

*Primary Examiner*—Paul E. Maslousky
*Attorney, Agent, or Firm*—Schuyler, Birch, Swindler, McKie & Beckett

[57] ABSTRACT

Step by step controlled servomechanism of the cylinder-type comprising a drive element movable in a case which it divides into two chambers and provided with a plurality of receiver ports, a distributor adapted to be put in communication with the high pressure and the low pressure and to supply said receiver ports, wherein said distributor is fixed and provided with a number of supply or transmitter ports at least equal to three but independent of the number of receiver ports, the transmitter ports being capable of being connected by permutation, in succession and in pairs, respectively to the low pressure and to the high pressure, the distance between the receiver ports and their length, on the one hand, the distance between the transmitter ports and their length, on the other hand, being such that, by the step by step displacement in one direction of the drive element, on one hand, it is possible to bring each time at least one receiver port between the two transmitter ports of a pair in such position that it communicates neither with one nor with the other of the transmitter ports but that any displacement in one direction or the other of the drive element puts in communication at least one receiver port respectively with one or the other of the two transmitter ports and, on the other hand, one of the transmitter ports of a following pair to be supplied with fluid communicates with a receiver port.

5 Claims, 19 Drawing Figures

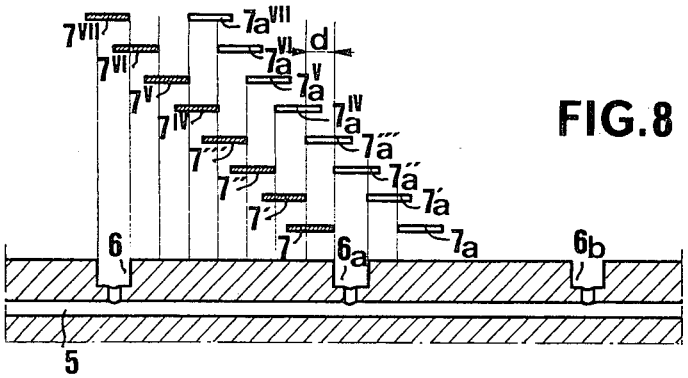
FIG.8
FIG.9
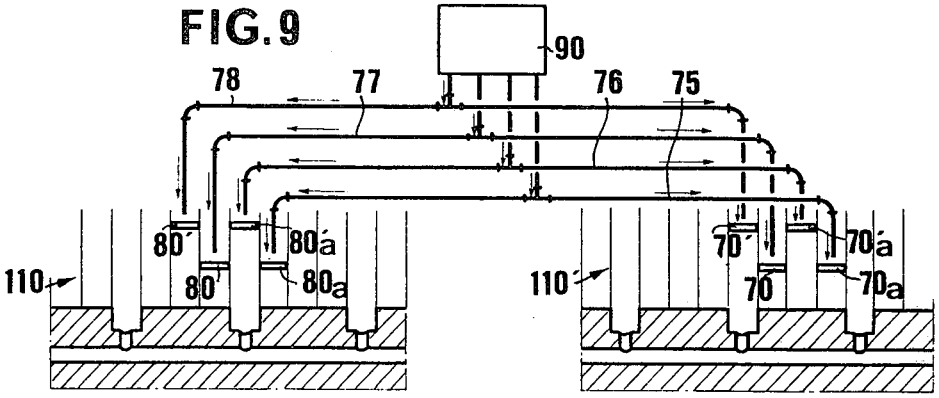
FIG.10
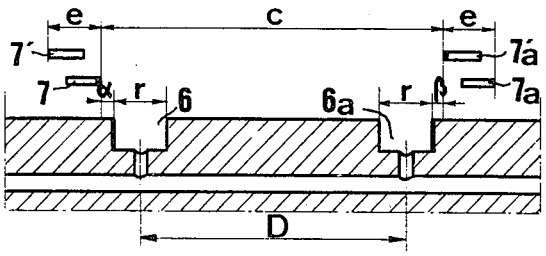
FIG.11
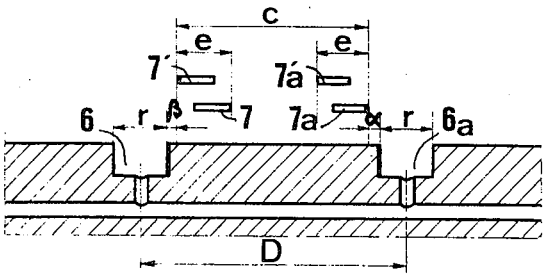

SERVOMECHANISM CONTROLLED STEP BY STEP

This is a continuation of application Ser. No. 346,328, filed Mar. 30, 1973, now abandoned.

Conventional cylinder-type servomechanisms employing fluid under pressure comprise a drive element movable in a case which it divides into two chambers at least one of which is supplied with fluid by way of a receiver port which a distributor is adapted to put in communication with the high pressure when the distributor is shifted in one direction and with the low pressure, when the distributor is shifted in the other direction. In a state of balance, the receiver occupies with respect to the high pressure port and to the low pressure port of the distributor, a position in which it is in communication with neither the high nor the low pressure and the arrangement is such that the movements of the distributor and of the receiver port follow each other therefore in a continuous manner.

An object of the present invention is to provide a servomechanism controlled step by step instead of continuously in the conventional manner.

Mechanisms controlled step by step have already been proposed in which are provided a plurality of ports capable of being connected in succession to the supply. Such systems are complicated in construction when a large number of positions of balance are required, since they require a supply selecting valve which has as many outlet ways as there are positions of balance.

The present invention provides on the contrary a distributor which is fixed and provided with a number of supply or transmitter ports at least equal to three but independent of the number of receiver ports, the transmitter ports being capable of being connected by permutation, in succession and in pairs, respectively to the low pressure and to the high pressure, the distance between the receiver ports and their length, on the one hand, the distance between the transmitter ports and their length, on the other hand, being such that, by the step by step displacement in one direction of the drive element, on one hand, it is possible to bring each time at least one receiver port between the two transmitter ports of a pair in such position that it communicates neither with one nor with the other of the transmitter ports but that any displacement in one direction or the other of the drive element puts in communication at least one receiver port respectively with one or the other of the two transmitter ports and, on the other hand, one of the transmitter ports of a following pair to be supplied with fluid communicates with a receiver port.

The first of these conditions is what may be termed the condition of hydraulic locking, that is to say, the maintenance of a stabilized position for each fixed order of supply of the transmitter means, and the second condition is what may be termed the condition of continuity, that is to say, the condition in respect of which the order of supply of the following pair of transmitter ports, which is judiciously selected, starting from the preceding stabilized position, results effectively in the supply of a receiver port and therefore the initiation of the movement of the drive element and the continuance of this movement throughout the duration of the step until the stabilized or locking position is reached.

Bearing in mind that under particular conditions, for example when starting, the drive element and the distributor may be in any relative position it is well, moreover, that no relative position of these elements be capable of resulting in a short circuit between the high and the low pressure. This requires a third condition for the relative dimensions and positions of the receiver and transmitter ports.

For each position of balance, the position of the receiver ports with respect to the transmitter ports is such that the resultant of the actions of the high and low pressure on the drive element counterbalances the action of the exterior forces exerted on said element.

With the arrangement according to the invention, the step by step displacement of the drive element in either direction can be achieved by the suitable permutation of the connections of the supply ports.

The step by step displacement of said element is therefore the result of the selection of successive pairs of transmitter ports.

It will be clear that if there are $m$ receiver ports and $n$ pairs of transmitter ports capable of being connected, in each pair, one to the high pressure and the other to the low pressure, it is possible to achieve, bearing in mind the aformentioned conditions as to the relative positions and dimensions of the ports, $m$ successions of $n$ different positions, that is to say, to impart to the cylinder a total number of $N = n \cdot m$ positions.

If it is possible to connect each of the transmitter ports to the high pressure as well as to the low pressure, it is obvious that the same total number of positions will be achieved with a number of transmitter ports which is half that corresponding to the case in which each transmitter port can be connected only to the high pressure or to the low pressure.

In the first case the distributor will be said to be "polarized" and in the second case "depolarized". In the depolarized distributor, each transmitter port will belong to two of the pairs of ports, which will be hereinafter termed "activated" pairs, ensuring the hydraulic locking, that is to say, the supply of fluid in stabilized operation (piston of the cylinder stationary).

In stabilized operation (piston of the cylinder stationary), the supply of fluid can be ensured by a single pair of transmitter ports and the distributor will then be termed a "simplex" distributor.

In a "simplex" distributor, there is a very short transitional operational condition during which the supply of fluid is cut off. This drawback does not exist in a "multiplex" distributor in which $q$ pairs of transmitter ports are supplied simultaneously in stabilized operation and $q-1$ ports are supplied during the short switching time (in a "duplex" distributor 2 pairs of ports are supplied with fluid in stabilized operation and a single remains supplied while the other is switched).

In a modification, the same port, connected for example permanently to the high pressure, is part of a plurality of different pairs. In this case the permutation of the supplies is effected on the other ports.

The number of step by step displacements is limited in the case of a linear drive element by the number of receiver ports. It may be infinite if this element is circular.

To summarize, the servomechanism according to the invention, termed hereinafter a numerical cylinder, is a step by step linear or rotary hydraulic motor in which a large number of output positions may be obtained by the action of a small number of binary control elements. Hereinafter, the description will be limited to the case of a differential rectilinear cylinder, that is to say, a cylinder in which only the pressure of one chamber, namely the larger chamber, is modulated whereas the high pressure is applied permanently to the smaller chamber. However, the invention is also applicable to the case of other types of hydraulic motors, in particular a double acting symmetrical cylinder in which the pressure of both chambers is modulated.

In a particular embodiment, there is provided a "depolarized" distributor having a quarternary cycle ($n$–4), that is to say, a distributor having four identical transmitter ports which are spaced equal distances apart and are capable of being connected to the high pressure as well as to the low pressure and receiver ports which are also identical and spaced wqual distances apart, the sum of the effective length of each transmitter port and the effective length of each receiver port being equal to twice the pitch of said transmitter ports, that is to say, twice the elementary pitch or unit advance, and the pitch of said receiver ports being equal to four times said elementary pitch.

There will now be described, with reference to the accompanying drawing, a number of embodiments of servomechanisms or cylinders according to the invention, the description being limited to the case of cylinders having equal steps, and there will be determined the dimensional requirements resulting from the three conditions defined hereinbefore.

In the drawing:

FIGS. 1*a*, 1*b*, 1*c* and 1*d* are diagrammatic sectional views, in four of its positions, of a cylinder having a ternary cycle comprising a depolarized simplex distributor having three transmitter ports and three receiver ports and which does not satisfy the no short-circuit condition;

FIGS. 2*a*, 2*b*, 2*c*, 2*d* and 2*e* are sectional views, in five of its positions, of a cylinder having a quaternary cycle and comprising a depolarized simplex distributor having four transmitter ports and three receiver ports all of which have the same width;

Figure 6:
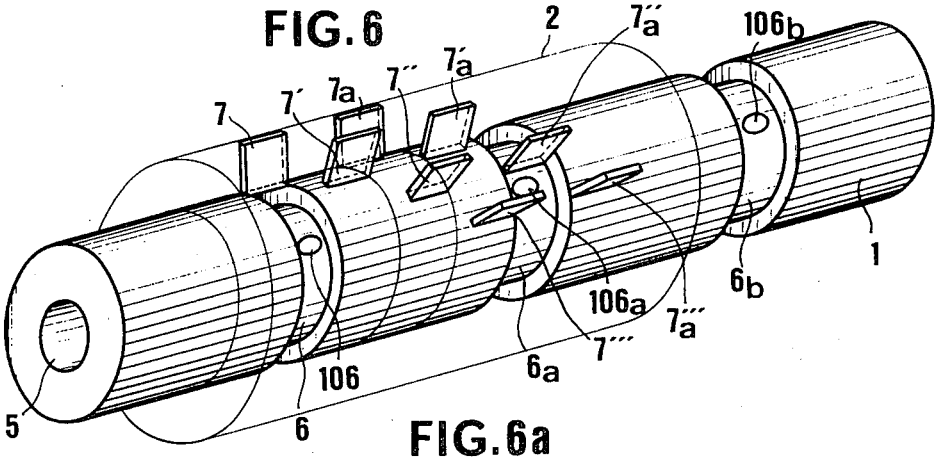
FIG. 6 is a diagrammatic perspective view of a cylinder having a simplex polarized distributor having four pairs of transmitter ports and three receiver ports.
Figure 6A:
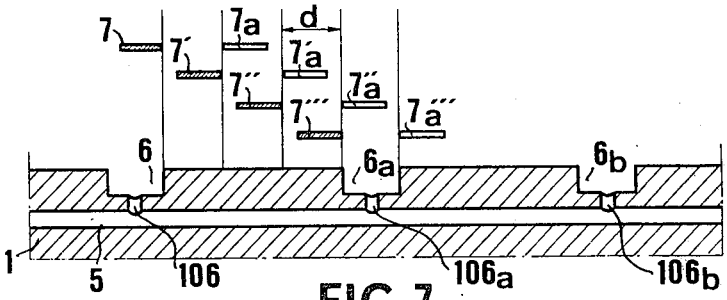
Figure 7:
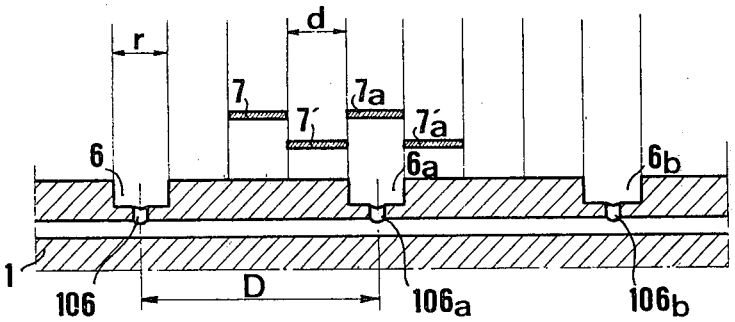

FIG. 6*a* is a symbolic representation of the cylinder shown in FIG. 6, this representation being adopted for all the following Figures;

FIG. 7 is a symbolic representation of a cylinder having a simplex depolarized distributor having four transmitter ports and three receiver ports;

FIG. 8 is a symbolic representation of a cylinder having a duplex polarized distributor having eight pairs of transmitter ports and three receiver ports;

FIG. 9 is a symbolic representation of a double-acting depolarized simplex numerical cylinder having two distributors each of which has four transmitter ports and supplied with fluid by a common selector cock;

FIG. 10 is a symbolic representation of a cylinder having a duplex polarized distributor which employs overlapping and in which the hydraulic locking is achieved by two different receiver ports, and FIG. 11 is a symbolic representation of a modification of the cylinder shown in FIG. 10.

In the embodiment shown in FIGS. 1*a*–1*d*, the servomechanism is constituted by a fluid cylinder device whose piston 1 moves in a cylinder 2, this piston dividing the cylinder into two chambers 3 and 4. The chamber 4 is in constant communication with the high pressure. Communicating with the chamber 3 is an axial conduit 5 which is provided in the piston 1 and with which communicate radial receiver ports 6, 6*a*, 6*b*, etc.. having the same length and separated by solid parts or lands of double size. Provided in the lateral wall of the cylinder 2 are three radial supply ports 7, 7′, 7″, which have the same length as the ports 6 and are spaced apart by solid parts or lands of the same dimension. These three transmitter ports 7 are respectively connected to the three output ports 8, 8′, 8″, which are arranged at 120° to each other in a cock 9 having a barrel 10 provided with two conduits 11, 12 arranged at 120° to each other and respectively connected to a low pressure source 14 and to a high pressure source 13.

The operation of this mechanism will be clear from the foregoing description.

Figure 1A:
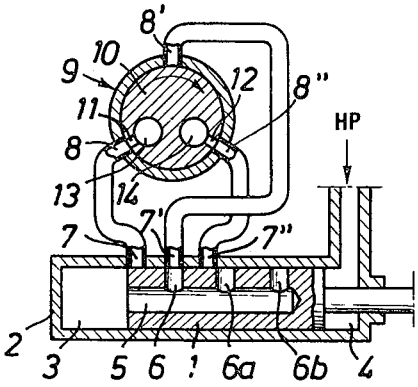
Figure 1B:
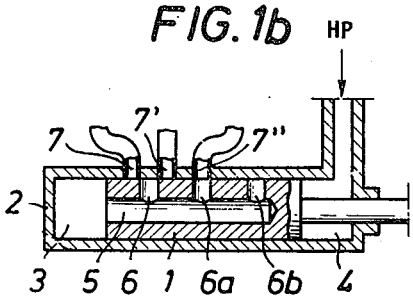
Figure 1C:
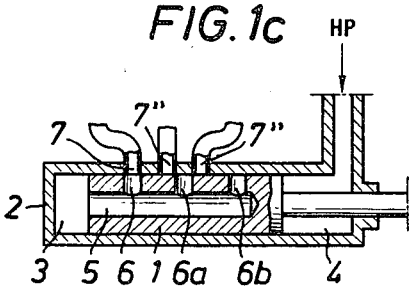
Figure 1D:
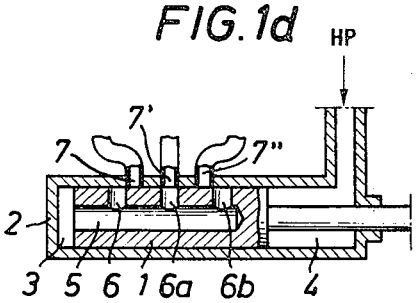

Starting at the position of balance shown in FIG. 1*a*, the barrel 10 of the cock 9 is turned through 120° in the direction indicated by the arrow (FIG. 1*a*) so as to bring the conduits 11 and 12 respectively in front of the ports 8′ and 8. The supply ports 7, 7′ are consequently respectively connected to the high pressure and to the low pressure and the port 7″ is closed. The piston 1 moves one step to the left (FIG. 1*b*) so that the port 6 is in balance the two ports 7 and 7′ connected to the high pressure and low pressure. A further rotation of the barrel 10 through 120° puts the ports 7′ and 7″ in communication with the high pressure and low pressure respectively and closes the port 7. The piston 1 effects a further step to the left (FIG. 1*c*) so that the port 6*a* is located between the two ports 7′ and 7″. A further rotation of the barrel 10 through 120° puts the ports 7 and 7′ in communication with the low pressure and high pressure respectively and the port 7′ is closed. The piston 1 again moves one step to the left (FIG. 1*d*) so that the same situation as shown in FIG. 1*a* is resumed, except that the piston is offset to the extent of one pitch of the receiver ports 7, 7′, 7″, which is three times one step of displacement of the piston.

If the barrel 10 is turned in the opposite direction, the piston 1 also moves in the opposite direction.

In the embodimment shown in FIGS. 2*a*–2*e*, the mechanism is of a type similar to that of FIGS. 1*a*–1*d*, and like elements or members carry the same reference characters. However, here four transmitter ports 7, 7′, 7″, 7‴ are provided so that it concerns a quarternary cycle. For each rotation of the barrel 10 through 90°, the piston 1 advances one step which is here one quarter of the pitch or distance between the receiver ports 6, 6*a*, 6*b* . . .

Figure 3:
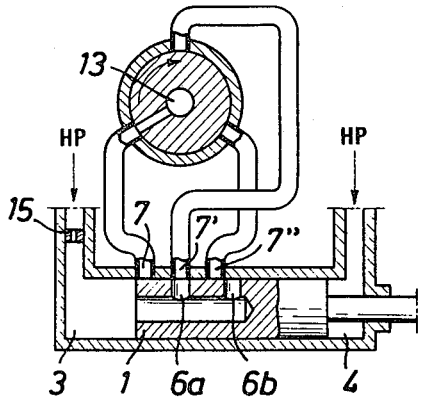
FIG. 3 is a sectional view of a servomechanism having a ternary cycle and a high pressure supply port common to all of the couples of selected ports.

In the embodiment shown in FIG. 3, the chamber 3 is permanently supplied with high-pressure fluid through a restriction port 15 and the transmitter ports 7, 7′, 7″ are connected in succession to the low pressure. The step by step displacement occurs as in the embodiment shown in FIGS. 1*a*–1*d*, the balance being ensured by a leakage flow.

Figure 4:
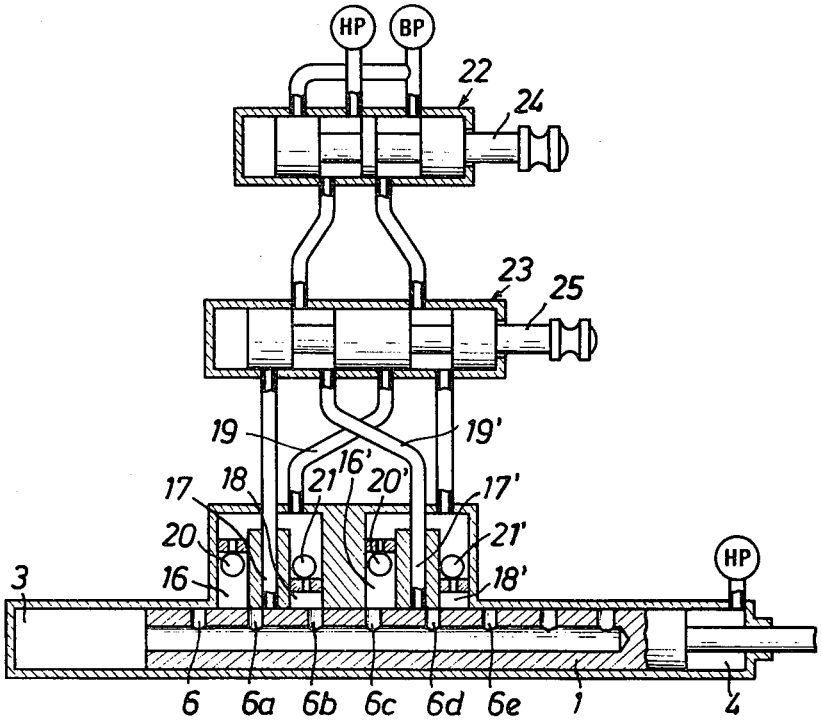
FIG. 4 is a sectional view of a servomechanism having an identical double arrangement of supply ports and a non-circular permutation of the directing of the pressures.

In the embodiment shown in FIG. 4, the selection of the pressures is not achieved, as in the preceding embodiments, by a circular permutation, the receiver ports 6, 6*a*, 6*b*, 6*c* . . . are supplied with fluid through two groups of identical transmitter port 16, 17, 18 and 16′, 17′, 18′. The length of the ports 17 and 17′ is equal to the length of the receiver ports 6 and the length of the ports 16, 18, 16′ and 18′ is twice the latter. The ports 16, 18 and 16′, 18′ are connected in parallel to the conduits, 19, 19′ respectively, but there are provided in the conduits of the ports 16 and 18 and in the conduits 16′ and 18′ ball check distributors 20, 21 and 20′, 21′ which are inverted with respect to each other. The conduits 17, 19 and 17′, 19′ are connected to the high pressure and to the low pressure through the slide distributors 22, 23 which are controlled by the control rods 24, 25 respectively. The slide distributors 23 controls the step by step displacement and the slide distributors 22 reverses the direction of this displacement.

It can be seen immediately that, in the position of balance shown in FIG. 4, the port 17′ communicates with the high pressure and the port 18′ with the low pressure. If the slide 23 is shifted to the left, the port 17 is connected to the high pressure and the port 18 to the low pressure and the piston 1 moves one step to the left.

It can be seen that in this embodiment, one pair of transmitter ports is employed for the balance, then another pair is employed by shifting the slide 22, then the first pair is returned to and once again the other pair is employed indefinitely. To obtain the movement in the opposite director the high and low pressures are reversed by actuating the slide distributor 22.

Figure 5:
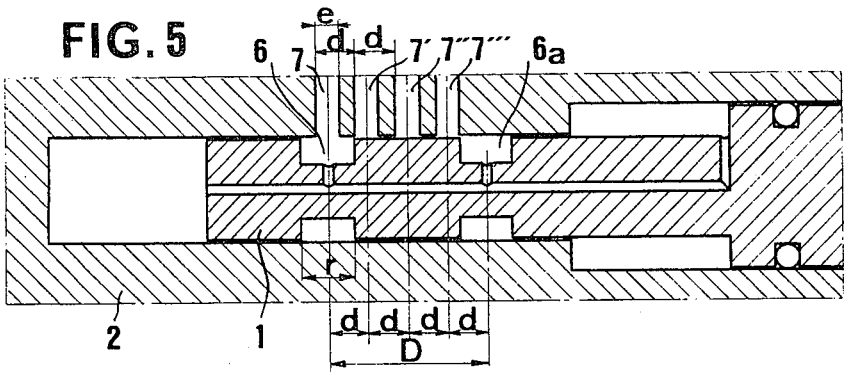
FIG. 5 is a diagrammatic sectional view of a cylinder having a quarternary cycle similar to the FIGS. 2*a*–2*e*, but having four transmitter ports and two receiver ports, the transmitter ports and the receiver ports having different widths.

In the embodiment shown in FIG. 5, there is represented a cylinder having a quarternary cycle, that is, four identical transmitter or supply ports 7, 7′, 7″, 7‴, having an effective length *e* and equally spaced apart at the elementary pitch (unit advance) *d*, and two identical receiver ports 6, 6*a* having an effective length *r* and spaced apart a distance D.

There will now be given in the case of this embodiment the dimensioning laws, that is to say the relations which must exist between the lengths *e*, *r*, D and *d* to satisfy the conditions of hydraulic locking, continuity and no short-circuit.

First, the hydraulic locking condition requires that two transmitter ports, namely 7‴ and 7′, respectively connected to the high pressure and low pressure, be each tangent to a receiver port (or to the same receiver port). In other words, here, the right edge of the port 7‴ is in alignment with the left edge of the port 6*a* and the left edge of the port 7′ is in alignment with the right edge of the port 6.

The continuity condition requires that, in order to effect a step equivalent to the pitch *d*, a transmitter port here port 7, which was previously not supplied, must be supplied with fluid. At the beginning of the movement, this port 7 must therefore communicate with a receiver port and, at the end of the movement, it must return to the same position with respect to this port, as the port 7‴ had with respect to the port 6*a* at the beginning of the movement.

It is also necessary that the port 7″, which was connected to the low pressure at the same time as the port 7 was connected to the high pressure, return to the same position with respect to a receiver port as the port 7′ with respect to the port 6 at the beginning of the movement.

In order to avoid multiplying the number of ports, it will be assumed that the reverse step (equivalent to $-d$) is obtained in putting this same port 7 in communication with the return. Consequently, after a movement through a step ($-d$), the port 7 must be in the same position with respect to a receiver port as the port 7′ was with respect to the port 6 at the beginning of the movement.

The no short-circuit condition requires that the port 7″ be closed off throughout the duration of the step *d*. In order to avoid an accidental short-circuit, it is well that the port 7″ be also closed by a displacement equal to at least one step but in the opposite direction ($-d$). The foregoing considerations give the following relations:

$$e + r = 2\,d$$

$$D = 4\,e$$

With the sole restrictive hypothesis which consists in the decision to use the same ports of the transmitter for supplying the fluid and the return according as it is desired to move one step in one direction or the other, the arrangement of FIG. 5 is obtained in which the ports 7‴ and 7′ ensure the initial positioning and are offset by one pitch with respect to the supply ports 7″ and 7 respectively.

To summarize, the quarternary numerical cylinder comprises, on the receiver ports or recesses having a length *r* and spaced apart a distance 4*d*, and on the transmitter, two pairs of ports of length $e = d - r$, the two ports of one pair, in each position, being closed and the two ports of the other pair pertaining, respectively, to the supply and to the return. The distance between two ports of one pair is $2d + 4\,kd$ and the distance two ports of different pairs is $d + 2\,k'd$.

Figure 2A:
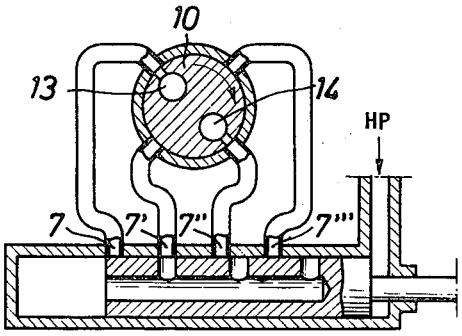
Figure 2B:
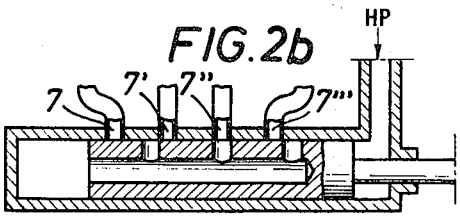
Figure 2C:
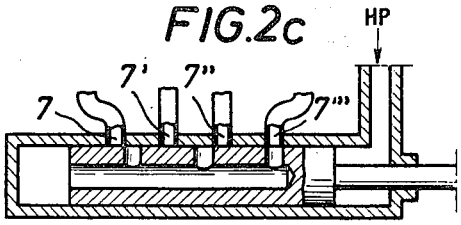
Figure 2D:
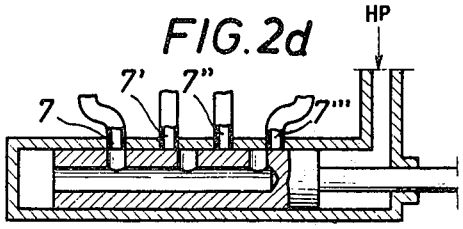
Figure 2E:
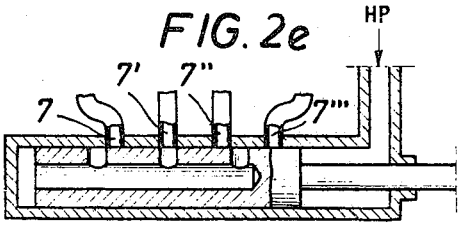

The two simplest arrangements are to provide equal distances between four ports spaced apart a distance *d* ($k = k' = 0$) which is the case shown in FIG. 5, or equal distances between four ports spaced apart a distance 3 *d* ($k = k' = 1$) which is the case shown in FIGS. 2*a*–2*c*.

It is clear that the relation: $e + r = 2d$ is no longer respected in the case of overlapping $\epsilon$ or uncovering-$\epsilon$ it must be replaced by:

$$e + r + \epsilon = 2d$$

There will now be determined with reference in succession to the embodiments shown in FIGS. 6–11, the dimensional requirements in cases which are more general than those just described.

In the embodiment shown in FIG. 6, there has been represented a cylinder having a simplex polarized distributor whose piston 1 moves in a cylinder 2 (here shown as if it were transparent for reasons of clarity). The piston 1 is provided with an axial bore 5 with which communicate the receiver ports 6, 6*a*, 6*b* constituted by transverse recesses which communicate with the bore 6 by way of apertures 106, 106*a* and 106*b*. Provided in the lateral wall of the cylinder 2 are eight transmitter or supply ports 7, 7*a*, 7′, 7′*a*, 7″, 7″*a* and 7‴, 7‴*a*. The ports 7, 7′, 7″ and 7‴ here can only be connected to the high pressure and the ports 7*a*, 7′*a*, 7''a and 7'''a can only be connected to the low pressure and the distributor is consequently "polarized".

In order to simplify the following explanations FIG. 6 shows a symbolic representation of the distributor in which the piston 1 is represented in axial section and the transmitter ports are represented by small rectangles whose length and spacing correspond to those of said ports and whose arrangement on lines parallel to the axis of the piston 1 results from the development in a plane of the lateral surface of said piston. The ports connected to the high pressure are represented by cross-hatched rectangles and the ports connected to the low pressure are represented by rectangles which have not been cross-hatched.

The cylinder device is shown in the hydraulic locking position, that is to say, any displacement of the piston 1 in one or the other direction results in a supply of fluid which returns it to its initial position. This locking is ensured by the fact that the right edge (or face) of the port 7''' is in alignment with the left edge of the port 6aand that the left edge of the port 7'''a is in alignment with the right edge of this port 6a. These edges may be termed "effective edges". Here, the effective transmitter edges face each other and they are termed "internal".

Among the four pairs of transmiter ports 7–7a, 7'–7'a, 7''–7''a and 7'''–7'''a, a single pair is supplied with fluid or activated in each locking position, that is to say operates under stabilized conditions. This cylinder is therefore of the simplex type.

It can be seen that the hydraulic locking condition is here constituted by the equation $c = r$, in which $c$ is the distance between the effective transmitter edges and $r$ the length of each receiver port.

The no short-circuit condition, which presupposes that no relative transmitter receiver position can result in a short-circuit between high pressure and low pressure, here signifies that the transmitter port 7'''a can communicate with the receiver port 6a, for example, whereas the transmitter port 7''' communicates also with the neighboring receiver port 6. It can be seen that this condition is represented by the inequality:

$$e + r \leqslant D/2$$

in which $e$ is the length of the transmitter ports and $D$ the pitch of the receiver ports (which is here equal to four times the unit pitch $d$ since there are four transmitter pairs).

The continuity condition, which presupposes that, in starting with the stabilized position shown in FIGS. 6 and 6a, the suitable supply of fluid to the cylinder device is in effect ensured when it receives the signal to assume an adjacent position and that this supply remains ensured throughout the duration of the unit step, here signifies that the transmitter port 7''a, for example, communicates with the receiver port 6a as soon as the port 7'''a ceases to communicate therewith. It can be seen that this condition is represented by the inequality:

$$e + r > d$$

in which $d$ is the unit pitch.

In the embodiment shown in FIG. 7, there has been represented symbolically a cylinder having a depolarized simplex distributor having two pairs of transmitter ports 7, 7a, 7', 7'a and three receiver ports 6, 6a, 6b. The distributor is said to be "depolarized" since the transmitter ports may all be connected to the high pressure and to the low pressure as in the case of the embodiments shown in FIGS. 1–5. The distributor is termed "simplex" since a single pair of transmitter ports is supplied at one time.

In this type of distributor, each end edge (or face) of a transmitter port is made to perform the function of an effective edge and co-operate with each receiver port, which presupposes that the left edge of the port 7', for example, comes, after two steps, into alignment with the right edge of the receiver port 6a. This is here represented, with four transmitter ports, by the equality:

$$e + r = 2d.$$

In the particular case shown in FIG. 7:

$$e = r = d.$$

The locking condition is represented by the same equality as in the case shown in FIG. 6, that is to say, $c = r$, and there is obtained here:

$$c = r = e = d.$$

The no short-circuit condition is, as for FIG. 6:

$$e + r \leqslant D/2$$

This is confirmed here since $D = 4d$ and $e + r = 2d$.

The continuity condition, as indicated in the case shown in FIG. 6:

$$e + r > d$$

is also respected here, since $e + r = 2d$.

The embodiment shown in FIG. 8 concerns a distributor of the "duplex" "polarized" type having eight pairs of transmitter ports 7, 7a, 7', 7'a . . . $7^{VII}$, $7'a^{VII}$ and three receiver ports 6, 6a, 6b. It is "polarized" since the ports 7, 7' . . . $7^{VII}$ can only be connected to the high pressure and the ports 7a, 7'a . . . $7'a^{VII}$ can only be connected to the low pressure, and it is "duplex" since two pairs of transmitter ports are connected simultaneously to the supply. In the position shown in FIG. 8, the pairs 7, 7a and 7', 7'a are those which are pressurized.

The hydraulic locking is ensured by the fact that the right edge of the port 7 is in alignment with the left edge of the port 6a and the left edge of the port 7'a is in alignment with the right edge of the port 6a.

The previously found locking condition $c = r$ is here satisfied provided that $c$ is given the direction of the distance between the effective transmitter edges. In the case of FIG. 6, the effective edges pertained to the same pair of transmitter ports. Here they pertain to ports pertaining to two neighbouring pairs.

The no short-circuit condition $e + r \leqslant D/2$ is here applicable in making $e$ not the length of each transmitter port but the sum of the lengths of the transmitter ports connected simultaneously, in stabilized operation, to the high or the low pressure, that is to say, in this case, the distance between the left edge of the port 7' and the right edge of the port 7. This conditions $e + r \leqslant D/2$ is here satisfied since it can be seen that $r = d$, $D = 8d$ and $e < 2d$.

The continuity condition which was, in the case of the "simplex" distributor shown in FIG. 6, $e + r > d$ must be generalized here by $e + r > 2d$ since $e$ represents the sum of the lengths of two transmitter ports and it is equal to the actual length of such a port increased by the unit pitch $d$ in the case where two pairs are pressurized simultaneously.

It will easily be seen that, in the general case of a "multiplex" distributor having an order of multiplicity $c$ that is to say, $q$ pairs of transmitter ports activated simultaneously in permanent operation, the continuity condition is expressed:

$$e + r > qd.$$

The embodiment shown in FIG. 9 represents the case of a numerical cylinder which is not single-acting as in all the foregoing embodiments but double-acting, that is to say, a cylinder in which the pressure is modulated in both chambers of the cylinder. It is clear from FIG. 9 that it is possible to supply both chambers of such a cylinder by means of two distributors 110, 110' respectively of the type described with reference to FIG. 7, that is to say, two "simplex", "depolarized" distributors having two pairs of transmitter ports 80, 81*a*, 80', 80'*a* and 70, 70*a*, 70', 70'*a* by means of a common selector 90 on condition that the receivers of the two distributors 110, 110' are offset or staggered two pitches.

Indeed, in the position shown in FIG. 9, the ports 70, 70*a* for the distributor 110' and 80, 80*a* for the distributor 110 ensure the locking since they are connected, by way of the conduits 75 and 77 to the high pressure and low pressure respectively. In order to shift the cylinder one step, it is sufficient to supply the ports 70' and 70'*a*, on one hand, and 80' and 80'*a*, on the other, by way of the conduits 78 and 76.

In the embodiments shown in FIGS. 10 and 11, there is represented symbolically a cylinder having a "duplex" "polarized" distributor whose locking is ensured by the ports of two pairs of different transmitter ports which are simultaneously pressurized.

In the case of FIG. 10, it is the left edge of the port 7'*a* and the right edge of the port 7 which are respectively in alignment with the right edge of the port 6*a* and the left edge of the port 6.

In the case of FIG. 11, it is the right edge of the port 7*a* and the left edge of the port 7' which are respectively in alignment with the left edge of the port 6*a* and the right edge of the port 6.

it may be said that, in the case of FIG. 10, the effective transmitter edges are "internal" and that, in the case of FIG. 11, that they are "external".

Further, in these two embodiments, it has been arranged that there is an overlapping $\epsilon$ (that is to say a short travel on each side $\alpha$ and $\beta$ ($\alpha + \beta = \epsilon$) that the cylinder device may effect in the vicinity of each position of balance or locking without the distributor opening the distribution. It is easy to prove that, in this case, the aforementioned formulae representing the locking conditions remain valid, on condition that $r$ is replaced by $r + \epsilon$ ($r$ being the length of the receiver ports).

In the embodiment shown in FIGS. 10 and 11, the locking in a given position employs not one receiver port, as in the preceding embodiments, but two receiver ports 6 and 6*a*. In this case, the locking condition is of course no longer $c = r$ but $c = r + D$ or $c = r + \epsilon + D$ in the case of FIG. 10, and $c = D - r$ or $c = D - (r + \epsilon)$ in the case of FIG. 11.

These formulae are easily generalized in the case where the two receiver ports employed for the locking are spaced apart a distance equal to $kD$. They become:

$$c = r + kD$$

or $$c = kD - r$$

It has been seen that the condition for which the depolarized distributor satisfies the no short-circuit and continuity conditions were:

$$e + r \leqslant D/2$$

that is to say $$e + r \leqslant nd/2$$

and $$e + r > qd$$

but it must also satisfy the condition:

$$e + r = kd.$$

Consequently, on one hand, $k \geqslant q + 1$ and, on the other, $n \geqslant 2q + 2$.

The minimum value of $n$ is therefore 4 for a simplex depolarized distributor. This distributor (with $n = 4$) has been described in the embodiment shown in FIGS. 2*a*–2*d*. It is one of the most attractive arrangements because the most simple.

The distributor described with reference to FIGS. 1*a*–1*d* (with $n = 3$) does not satisfy the no short-circuit condition. It is therefore dangerous to use.

What I claim is:

1. Step by step controlled servomechanism adapted to resist an external force comprising a. a cylinder (2);

b. a drive element (1) movable in said cylinder in first and second opposed directions, said drive element driving said cylinder into two chambers, (3,4) said drive element being provided with a plurality of spaced receiver ports (6) opening into one of said chambers (3);

c. a high pressure supply (HP) continuously applied to the other one of said chambers (4);

d. a high pressure source (13) and a low pressure source (14);

e. a distributor (9) for providing selective communication between said high pressure (13) and low pressure (14) sources and said receiver ports (6), said distributor (9) including a number of spaced transmitter ports (7) in the wall of said cylinder (2) at least equal to three but independent of the number of said receiver ports, the distance between adjacent receiver ports (6) being different than the distance between adjacent transmitter ports (7), said receiver ports (6) adapted to communicate with said transmitter ports (7), said distributor (9) further including means (10) for connecting said transmitter ports (7) by permutation, in succession and in pairs, respectively, to said low pressure source (14) and to said high pressure source (13), f. at least some of said receiver ports being located adjacent a pair of said transmitter ports in such a position that said adjacently located receiver ports communicate neither with one nor with the other of said pair of transmitter ports, said pair of transmitter ports being coupled by said connecting means (10) to said high and low pressure sources, respectively, whereby a displacement in said first or second directions of said drive element due to the external force thereon puts one of said adjacently located receiver ports in communication with one or the other of said pair of transmitter ports to resist the external force thereby effecting a hydraulic locking of said drive element, and g. another of said receiver ports being in communication with one of the transmitter ports of a next pair of transmitter ports to be coupled by said connecting means (10) with said high and low pressure sources, respectively, to thereby effect a step by step displacement of said drive element

2. Servomechanism according to claim 1, wherein the relative positions and dimensions of said receiver ports and said transmitter ports are such that said ports are not capable of resulting in a communication between high and low pressure, whatever be the relative position of said drive element and said distributor and whatever be the pairs of transmitter ports supplied by the distributor.

3. Servomechanism according to claim 2, wherein said distributor comprises four identical transmitter ports (7, . . . ) which are spaced equal distances apart and are capable of being connected to the high pressure as well as to the low pressure and said receiver ports (6, 6*a* . . . ) are also identical and spaced equal distances apart, the sum of the effective length (*d*) of each transmitter port (7) and the effective length (*d*) of each receiver port (6) being equal to twice the elementary pitch or unit advance (*d*), and the pitch (D) of said receiver ports (6) being equal to four times said elementary pitch (*d*).

4. Servomechanism according to claim 1 wherein the transmitter ports can be connected only either to the high pressure or to the low pressure and the relative dimensions and positions of the transmitter and receiver ports meet the following conditions:

$$c = r + \epsilon + kD$$

$$e + r + \epsilon \leq D/2$$

$$e + r > qd$$

where:

*c* is the distance between the edges (or faces) of the transmitter ports which co-operate to the hydraulic locking of the drive element;

*r* is the length of each receiver port;

*D* is the pitch of the receiver ports;

*d* is the unitary pitch, i.e. the quotient of *D* by the number of pairs of transmitter ports;

*q* is the number of pairs of transmitter ports which are simultaneously supplied in the stabilized operation;

*e* is the cumulated length of the *q* transmitter ports connected simultaneously to the same source of pressure, in the stabilized operation;

*k* is the difference between the rank numbers of the receiver ports co-operating for the hydraulic locking in a given position;

$\epsilon$ is the overlapping i.e. the maximum value of the short travel that the drive element may effect in the vicinity of each position of balance without opening the distribution.

5. Servomechanism according to claim 1 wherein the relative dimensions and positions of the transmitter and receiver ports meet the following conditions:

$$c = r + + kD$$

$$e + r + D/2$$

$$e + r\ qd$$

$$e + r + = k'd\ q + 1$$

where

*c* is the distance between the edges (or faces) of the transmitter ports which co-operate to the hydraulic locking of the drive element;

*r* is the length of each receiver port;

*D* is the pitch of the receiver ports;

*d* is the unitary pitch, i.e., the quotient of *D* by the number of pairs of transmitter ports;

*q* is the number of pairs of transmitter ports which are simultaneously supplied in the stabilized operation;

*e* is the cumulated length of the *q* transmitter ports connected simultaneously to the same source of pressure, in the stabilized operation;

*k* is the difference between the rank numbers of the receiver ports co-operating for the hydraulic locking in a given position;

is the overlapping, i.e., the maximum value of the short travel that the drive element may effect in the vicinity of each position of balance without opening the distribution.

* * * * *

UNITED STATES PATENT OFFICE

CERTIFICATE OF CORRECTION

Patent No. 4,014,248 Dated March 29, 1977

Inventor(s) Luc Cyrot

It is certified that error appears in the above-identified patent and that said Letters Patent are hereby corrected as shown below:

Column 3, line 16, "wqual" should read --equal--;

Column 4, line 39, after "balance" insert --between--;

Column 6, line 39, after "distance" insert --between--;

Column 9, line 7, "c" should read --q--;

Claim 1, line 6, "driving" should read --dividing--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*